US008529371B2

(12) United States Patent
Watanabe

(10) Patent No.: US 8,529,371 B2
(45) Date of Patent: Sep. 10, 2013

(54) GOLF BALL

(75) Inventor: Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 1031 days.

(21) Appl. No.: 11/950,513

(22) Filed: Dec. 5, 2007

(65) Prior Publication Data

US 2008/0076604 A1 Mar. 27, 2008

Related U.S. Application Data

(63) Continuation of application No. 11/503,992, filed on Aug. 15, 2006, now Pat. No. 7,322,892.

(51) Int. Cl.
*A63B 37/06* (2006.01)

(52) U.S. Cl.
USPC ..... 473/373

(58) Field of Classification Search
USPC ..... 473/373, 374, 368, 367
See application file for complete search history.

(56) References Cited

U.S. PATENT DOCUMENTS

| | | | | |
|---|---|---|---|---|
| 4,839,116 | A | 6/1989 | Puckett et al. | |
| 4,919,434 | A * | 4/1990 | Saito | 473/373 |
| 5,209,485 | A | 5/1993 | Nesbitt et al. | |
| 5,273,287 | A | 12/1993 | Molitor et al. | |
| 5,929,189 | A | 7/1999 | Ichikawa et al. | |
| 6,248,028 | B1 | 6/2001 | Higuchi et al. | |
| 6,419,595 | B1 | 7/2002 | Maruko et al. | |
| 6,592,470 | B2 | 7/2003 | Watanabe et al. | |
| 6,663,507 | B1 * | 12/2003 | Watanabe et al. | 473/373 |
| 6,814,676 | B2 | 11/2004 | Watanabe et al. | |
| 2004/0029650 | A1 * | 2/2004 | Higuchi et al. | 473/371 |
| 2004/0033847 | A1 * | 2/2004 | Higuchi et al. | 473/371 |

FOREIGN PATENT DOCUMENTS

| | | | |
|---|---|---|---|
| JP | 60-194967 | A | 10/1985 |
| JP | 9-271538 | A | 10/1997 |
| JP | 11-104270 | A | 4/1999 |
| JP | 2002-315848 | A | 10/2002 |
| JP | 2003-190330 | A | 7/2003 |
| JP | 2004-49913 | A | 2/2004 |

OTHER PUBLICATIONS

Office Action dated Dec. 20, 2011 issued in a corresponding Japanese Patent Publication No. 2007-191883.

* cited by examiner

*Primary Examiner* — Raeann Gorden
(74) *Attorney, Agent, or Firm* — Sughrue Mion, PLLC

(57) ABSTRACT

The present invention provides a golf ball having a resilient core made of rubber, a cover of one or more layer encasing the core, and at least one intermediate layer disposed between the core and the cover, wherein the cover is made primarily of polyurethane, the intermediate layer is made primarily of ionomer, and the core has a surface hardness which is higher than the material hardnesses of the cover and the intermediate layer. The golf ball is able to limit the distance of travel more than official balls currently in use and, in spite of being a limited-distance golf ball, imparts a relatively soft and good ball feel on impact, in addition to which it has an excellent scuff resistance and, by minimizing the extent of decrease in the distance traveled by the ball when hit with an iron, minimizes the effect on golf play by amateur golfers.

9 Claims, 1 Drawing Sheet

GOLF BALL

This is a continuation of application Ser. No. 11/503,992 filed Aug. 15, 2006. The entire disclosure of the prior application, application Ser. No. 11/503,992 is hereby incorporated by reference.

BACKGROUND OF THE INVENTION

The present invention relates to a multi-piece golf ball having at least a three-layer construction composed of a core, an intermediate layer, and a cover. More specifically, it relates to a golf ball having a reduced distance of travel compared with official balls in current use.

There are primarily two sets of Rules of Golf: one issued by the Royal and Ancient Golf Club of St. Andrews (R&A) and one issued by the United States Golf Association (USGA). Both are revised every few years to maintain the integrity of golf competition. Investigations on limiting the distance of golf balls in these Rules of Golf are slowly being carried out.

Of the golf balls that have been disclosed to date, a few are golf balls which intentionally limit the flight performance or are designed to travel a short distance. For example, JP-A 60-194967 describes a short distance golf ball which includes a foam-molded thermoplastic resin polymer and filler material, and has a density gradient that increases along the ball radius from the center to the surface of the ball.

However, although this golf ball does lower the ball initial velocity by decreasing the rebound resilience of the core material, the controllability and scuff resistance leave something to be desired.

U.S. Pat. No. 5,209,485 teaches a golf ball which has a low rebound and reduced distance. However, this ball has a high hardness and thus an unpleasant feel on impact.

U.S. Pat. No. 5,273,287 discloses a large-diameter golf ball having a diameter of 1.70 to 1.80 inches (43.18 to 45.72 mm), a weight of not more than 1.62 ounces, and a dimple surface coverage of at least 70% relative to the spherical surface of the ball. Yet, because the ball is larger than normal, it feels strange to the player. Also, the feel on impact has not been improved. Furthermore, manufacturing such large-diameter balls would require that major modifications be made to the design and production equipment for golf balls having a conventional ball diameter, and would adversely impact the productivity.

U.S. Pat. No. 6,248,028 (corresponding Japanese application: JP-A 11-104270), U.S. Pat. No. 6,663,507 (corresponding Japanese application: 2004-049913), U.S. Pat. No. 6,814,676 (corresponding Japanese application: 2003-190330) and U.S. Pat. No. 6,592,470 (corresponding Japanese application: 2002-315848) disclose multi-piece solid golf balls obtained by forming the cover of a thermoplastic polyurethane elastomer, and forming between the core and cover an intermediate layer of a thermoplastic polyester elastomer and a high-resilience ionomer. These golf balls have excellent overall ball properties, including not only flight, but also feel when played, controllability, spin stability, scuff resistance and durability to repeated impact. Yet, such multi-piece solid golf balls are all aimed primarily at achieving superior flight properties, and will often not be suitable for the limited-distance standardized balls which will be required in the future.

SUMMARY OF THE INVENTION

It is therefore an object of the present invention to provide a golf ball in which the distance traveled can be reduced compared with official golf balls in current use and which, in spite of being a limited-distance ball, has a relatively soft and good feel on impact, has an excellent scuff resistance and minimizes the extent of the decrease in the distance traveled by the ball when hit with an iron, thus having little adverse effect on play by the amateur golfer.

The inventor has found from extensive investigations that by using a polyurethane cover as the outermost layer (cover), using a rubber-based core at the center, and disposing therebetween an intermediate layer composed primarily of a relatively soft ionomer, the ball compression will be soft and the actual initial velocity when the ball is hit, particularly with a number one wood (W#1) at a high head speed, can be lowered considerably, enabling a distance-limiting effect to be achieved when the ball is hit by a professionals and other skilled players, particularly with a W#1.

That is, the present invention is based on the discovery, from repeated and extensive investigations conducted on the construction of the distance-limited golf balls which are likely to be required in the near future according to the USGA and R&A criteria, that in golf balls having at least the following four conditions or features the distance traveled by the ball when hit at a high head speed by professionals and other skilled golfers can be limited, while yet enabling golf play to remain enjoyable when the ball is used by amateur golfers. The four conditions or features are: (1) that the golf ball have a three-layer construction composed of a resilient core, a cover and an intermediate layer disposed therebetween, (2) to impart the ball with a controllability which allows it to be used even by professionals and other skilled golfers, and enable the ball to manifest an excellent scuff resistance, it is effective for the cover to be made primarily of a polyurethane such as a thermoplastic polyurethane elastomer; (3) making the intermediate layer primarily of an ionomer, particularly a low-resilience ionomer, enables the effect of imparting a soft feel on impact that is acceptable to the golfer to be achieved; and (4) by forming the core to a surface hardness which is higher than the material hardnesses of the cover and the intermediate layer, in spite of the ball being distance-limited when hit with a W#1, the extent of the decrease in distance by the ball when hit with an iron can be minimized relative to the prior art, enabling golf play to remain enjoyable even when the ball is used by amateur golfers.

Accordingly, the invention provides the following golf balls.

[1] A golf ball comprising a resilient core made of rubber, a cover of one or more layer encasing the core, and at least one intermediate layer disposed between the core and the cover, wherein the cover is made primarily of polyurethane, the intermediate layer is made primarily of ionomer, and the core has a surface hardness which is higher than the material hardnesses of the cover and the intermediate layer.

[2] The golf ball of [1], wherein, letting V be the initial velocity (m/s) of the ball as measured by a method set forth in the Rules of Golf using an initial velocity measuring apparatus of the same type as the USGA drum rotation-type initial velocity instrument and letting E be the deflection (mm) of the ball when subjected to compression from an initial load state of 98 N (10 kgf) to a final load of 1,275 N (130 kgf), the value of V/E is at most 28.

[3] The golf ball of [1], wherein the initial velocity V of the ball is at least 65 m/s but not more than 76.2 m/s.

[4] The golf ball of [1], wherein the deflection E of the ball is at least 2.8 mm.

BRIEF DESCRIPTION OF THE DIAGRAMS

DETAILED DESCRIPTION OF THE INVENTION

Figure 1:
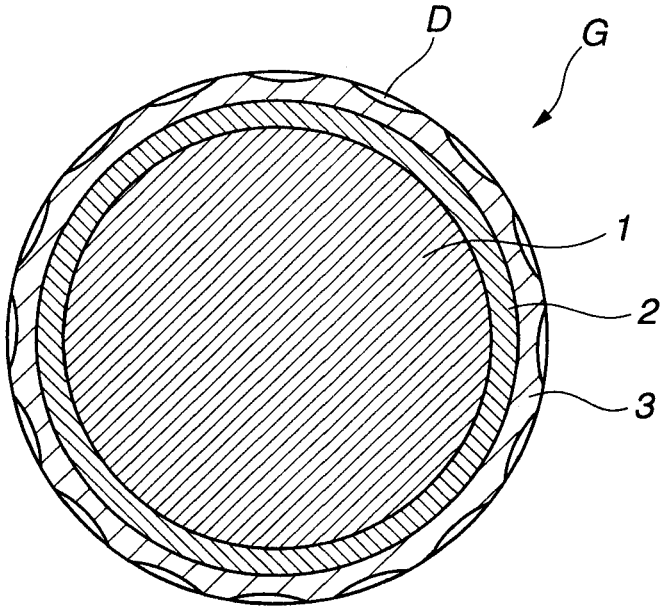
FIG. 1 is a schematic sectional view of a golf ball (three-layer structure) according to one embodiment of the invention.

The golf ball of the invention has a core, a cover of one or more layer which encases the core, and at least one intermediate layer which is disposed between the core and the cover. An example is the multi-piece solid golf ball G shown in FIG. 1. This golf ball has a multi-layer construction with a core 1 serving as the innermost layer, a cover 3 as the outermost layer, and a single intermediate layer 2 therebetween. The cover 3 has numerous dimples D formed on the outside surface thereof. The intermediate layer 2 and cover 3 may each be composed of a single layer or a plurality of layers. The construction of the inventive ball is not limited to that shown in FIG. 1.

A detailed description is given below of the core, intermediate layer, cover and the dimples that are optionally formed.

The core has a diameter of generally at least 35 mm but not more than 40 mm, preferably at least 36 mm but not more than 39 mm, and more preferably at least 37 mm but not more than 38 mm. If the core diameter is too much larger than the above range, the rebound becomes too high, which may result in an excessive distance when the ball is hit with a W#1. Conversely, if the core diameter is smaller than the above range, the spin rate may increase too much when hit with an iron, resulting in an excessive loss of distance.

The core has a surface hardness as measured with a type D Durometer in accordance with ASTM D-2240 (referred to below as "Shore D hardness") of generally at least 45 but not more than 60, preferably at least 50 but not more than 58, and more preferably at least 52 but not more than 56. The core has a center hardness, expressed as the Shore D hardness, of generally at least 25 but not more than 50, preferably at least 30 but not more than 45, and more preferably at least 35 but not more than 40. If the surface hardness or center hardness of the core is too much smaller than the above range, the feel on impact may be too soft and the durability to cracking on repeated impact may worsen. On the other hand, if the value is too large, the feel on impact when a full shot is taken may be too hard and the spin rate may increase too much, resulting in a shorter than desirable distance.

The difference between the two above hardnesses, i.e., the hardness difference obtained by subtracting the core center hardness from the core surface hardness, expressed in Shore D hardness units, is generally at least 10 but not more than 30, preferably at least 15 but not more than 25, and more preferably at least 17 but not more than 20. If this hardness difference is too small, the spin rate when hit with a W#1 may become too high, resulting in a trajectory that describes a high arc, so that the ball may be unduly subject to the influence of wind, making it more difficult to play golf. On the other hand, if the above hardness difference is too large, the rebound may become too low, as a result of which the distance traveled by the ball may decrease excessively not only when the ball is hit with a W#1 but even when it is hit with an iron, in addition to which the durability of the ball to repeated impact may become too poor.

The deflection by the core, which is the measured amount of deformation by the core when compressed under a final load of 1,275 N (130 kgf) from an initial load state of 98 N (10 kgf), is generally at least 3.0 mm but not more than 5.5 mm, preferably at least 3.4 mm but not more than 5.0 mm, and more preferably at least 3.8 mm but not more than 4.5 mm. At a value which is too much higher than the above range, the feel may become too soft and the durability to cracking under repeated impact may worsen. Conversely, if the above value is too low, the feel on impact when a full shot is taken may be too hard and the ball may take on excessive spin, resulting in a shorter distance than desired when played with an iron.

In the practice of the invention, it is critical that the core be formed so as to have a surface hardness which is higher than the subsequently described material hardnesses of the intermediate layer and the cover. This is done so that the ball does not fly too far due to a lower spin rate when the ball is hit with a W#1. The essential conditions in the invention are individually described below in the sections on the intermediate layer and the cover.

A resilient core made of rubber may be used as the core material having the above hardness and deflection, and is not subject to any particular limitation. Illustrative examples include materials obtained by using any of various synthetic rubbers (e.g., polybutadiene rubber, polyisoprene rubber, styrene-butadiene rubber) as the base rubber, and compounding with the base rubber various known compounding ingredients, such as an unsaturated carboxylic acid or a metal salt thereof (e.g., zinc acrylate), an organic peroxide, an inert filler (e.g., zinc oxide, barium sulfate), and an antioxidant.

It is preferable to include sulfur in the base rubber. The amount of sulfur compounded per 100 parts by weight of the base rubber may be adjusted within a range of generally 0.05 to 0.5 part by weight, preferably 0.07 to 0.3 part by weight, and more preferably 0.09 to 0.2 part by weight. If the amount of sulfur included is too much lower than the above range, a sufficient hardness difference between the surface and center of the core may not be attainable. Conversely, if the amount of sulfur compounded is too much higher than the above range, the core rebound may become too low and the ball may also have a low rebound, as a result of which a sufficient distance may not be achieved when the ball is played with a W#1 or even when played with an iron.

An organosulfur compound may also be included in the base rubber. The amount of the organosulfur compound included per 100 parts by weight of the base rubber may be adjusted within a range of generally 0.05 to 5 parts by weight, preferably 0.1 to 4 parts by weight, and more preferably 0.2 to 2 parts by weight. If the amount of organosulfur compound included is too low, the core rebound may end up being too low and the ball itself may also have a low rebound, as a result of which a sufficient distance may not be achieved when the ball is played with a W#1 or even when played with an iron. Conversely, if the amount of organosulfur compound is too high, the core hardness may end up being too low, resulting in a poor feel on impact, and the durability to cracking on repeated impact may worsen.

The above-described sulfur and organosulfur compound may both be included in the base rubber. In such a case, the relative proportions of the organosulfur compound and sulfur (amount of organosulfur compound/amount of sulfur) is preferably at least 1 but not more than 30, more preferably at least 3 but not more than 25, and even more preferably 5 but not more than 20. If this value is too small, the ball may have a low rebound, as a result of which a sufficient distance may not be achieved when the ball is played with a W#1 or even when played with an iron. On the other hand, if this value is too high, the ball may have too low a hardness and the hardness difference between the core surface and core center may be insufficient, resulting in an increased spin rate and greater susceptibility to the influence of wind.

Any suitable known method may be employed to form the above core. For example, the core-forming rubber composition may be masticated using an ordinary mixing apparatus (e.g., Banbury mixer, kneader, or roll mill), and the resulting compound may be molded under heat and compression in a core mold. Core formation may be carried out using as the vulcanization conditions for the core-forming rubber composition a vulcanization temperature of 100 to 200° C. and a vulcanization time of 10 to 40 minutes.

The intermediate layer has a material hardness, expressed as the Shore D hardness, of generally at least 40 but not more than 60, preferably at least 43 but not more than 56, and more preferably at least 46 but not more than 52. If the intermediate layer is too much softer than the above range, the golf ball may take on too much spin on full shots with an iron, resulting in a shorter than desirable distance. Conversely, if the intermediate layer is too much harder than the above range, the spin may decrease excessively when the ball is hit with a W#1, resulting in too high a rebound so that the ball travels too far.

The term "material hardness" used above refers to the hardness of the intermediate layer material itself, not the hardness at the surface of the spherical body obtained by encasing the core in the intermediate layer. Specifically, the material hardness is the sheet hardness obtained by molding the intermediate layer material into a sheet having a specific thickness in a range of 1 to 2 mm, and measuring the hardness of the resulting molded sheet. The same applies to the material hardness of the subsequently described cover.

<Hardness Relationship Between Intermediate Layer and Core Surface>

It is critical for the intermediate layer to have a material hardness which is softer than the hardness of the core surface. Specifically, the difference between the intermediate layer hardness and the core surface hardness (intermediate layer hardness−core surface hardness), expressed in Shore D hardness units, is preferably −2 or below, and more preferably −4 or below. The lower limit in this hardness difference is preferably −12 or above, more preferably −10 or above, and even more preferably −8 or above. If, contrary to the required conditions of the invention, the intermediate layer is harder than the core surface, the spin rate of the ball when hit with a W#1 may decrease, as a result of which the ball may travel too far. On the other hand, if the material hardness of the intermediate layer with respect to the material hardness at the core surface is too much softer than the above numerical range, the spin rate of the ball when hit with a W#1 may rise excessively, resulting in a trajectory that describes a high arc, making it more difficult to play golf. Even when the ball is hit with an iron, the spin rate of the ball may rise excessively, resulting in a drop in the distance traveled by the ball.

The intermediate layer has a thickness of generally at least 0.7 mm but not more than 3.0 mm, preferably at least 1.2 mm but not more than 2.5 mm, and more preferably at least 1.5 mm but not more than 2.0 mm. If the intermediate layer is thinner than the above range, the rebound of the ball when hit with a W#1 may not be sufficiently suppressed, resulting in too much distance. On the other hand, if the intermediate layer is thicker than the above range, the ball may take on too much spin on shots with an iron, resulting in a drop in the distance. The foregoing intermediate layer thickness refers to a numerical range for the total thickness of the intermediate layer, including cases in which the intermediate layer is composed of one single layer and cases where it is composed of two or more discreet layers.

In the practice of the invention, the intermediate layer is made primarily of an ionomer material. When various elastomer materials, such as polyester elastomers, are used as the intermediate layer material, the rebound ends up being too high, which may fail to provide a sufficient distance-limiting effect when the ball is hit with a W#1. The use of an ionomer is also preferable from the standpoint of moldability and production considerations.

Specific examples of ionomers that may be used as the intermediate layer material include the following, all available from DuPont-Mitsui Polychemical Co., Ltd.: ionomers neutralized with zinc ions, such as Himilan 1554, Himilan 1557, Himilan 1650, Himilan 1652, Himilan 1702, Himilan 1706 and Himilan 1855; and ionomers neutralized with sodium ions, such as Himilan 1555, Himilan 1601, Himilan 1605, Himilan 1707, Himilan 1856 and Himilan AM7331. Additional examples include the following available from E.I. DuPont de Nemours & Co.: ionomers neutralized with lithium ions, such as Surlyn 7930, and ionomers neutralized with sodium ions, such as Surlyn 8120. From the standpoint of suppressing the rebound and imparting a high durability, it is preferable to include in the intermediate layer material a ternary ionomer. In particular, to additionally impart a high durability, it is preferable for the ternary ionomer to be an ionomer neutralized with sodium ions. In this case, the amount of the ternary ionomer included per 100 parts by weight of the overall amount of intermediate layer material is preferably at least 10 parts by weight, more preferably at least 30 parts by weight, and even more preferably at least 60 parts by weight.

Various additives may be optionally included in the above-described intermediate layer material. For example, inorganic fillers such as zinc oxide, barium sulfate and titanium dioxide, pigments, dispersants, antioxidants, ultraviolet absorbers, and light stabilizers may be added.

To increase adhesion of the intermediate layer with the urethane rubber used in the subsequently described cover, it is preferable to grind the surface of the intermediate layer. Moreover, after grinding the surface of the intermediate layer, it is recommended that the surface be painted with a primer or that an adhesion enhancer be added to the intermediate layer material.

In the practice of the invention, the material hardness of the cover, expressed as the Shore D hardness, is generally at least 40 but not more than 60, preferably at least 43 but not more than 56, and more preferably at least 46 but not more than 52. If the cover is softer than the above range, the ball may take on too much spin on full shots with an iron, resulting in too large a drop in the distance when the ball is hit with a short iron. Conversely, if the cover is harder than the above range, the ball may fail to take on spin on shots with a W#1, resulting in an excessive distance, and the scuff resistance of the ball may worsen.

<Hardness Relationship of Cover and Core Surface>

It is critical for the cover to have a material hardness which is softer than the hardness at the core surface. Specifically, this hardness difference (cover hardness−core surface hardness), expressed in Shore D hardness units, is preferably −2 or below, and more preferably −4 or below. The lower limit in this hardness difference is preferably −12 or above, more preferably −10 or above, and more preferably −8 or above. If, contrary to the required conditions of the invention, the cover is harder than the core surface, the spin rate of the ball when hit with a W#1 may decrease, as a result of which the ball may travel too far. On the other hand, if the material hardness of the cover with respect to the material hardness at the core surface is too much softer than the above numerical range, the spin rate of the ball when hit with a W#1 may rise excessively, resulting in a trajectory that describes a high arc, and thus making it more difficult to play golf. Even when the ball is hit with an iron, the spin rate of the ball may become too high, resulting in a drop in the distance traveled by the ball.

The cover has a thickness of generally at least 0.3 mm but not more than 2.0 mm, preferably at least 0.6 mm but not more than 1.5 mm, and more preferably at least 0.8 mm but not more than 1.2 mm. If the cover layer is thicker than the above range, the spin rate may become too high when the ball is hit with an iron. On the other hand, if the cover is too much thinner than the above range, the scuff resistance may worsen, resulting in less than adequate controllability even for professionals and other skilled golfers.

For controllability and scuff resistance, the material used to form the above cover is preferably composed primarily of polyurethane. This material is not subject to any particular limitation, so long as it is composed primarily of polyurethane. However, for good mass productivity, it is especially desirable to use a thermoplastic polyurethane material. Illustrative examples are given below.

Preferred examples of the cover in the invention include covers made of a cover-molding material (C) composed primarily of the following components (A) and (B):

(A) a thermoplastic polyurethane material; and (B) an isocyanate mixture of (b-1) an isocyanate compound having two or more isocyanate groups as functional groups per molecule, dispersed in (b-2) a thermoplastic resin is substantially non-reactive with isocyanate.

In the practice of the invention, when the cover is made of the above cover-molding material (C), a golf ball having a better feel, controllability, cut resistance, scuff resistance and durability to cracking under repeated impact can be obtained.

Components (A) to (C) are described below.

(A) Thermoplastic Polyurethane Material

The thermoplastic polyurethane material has a morphology which includes soft segments composed of a polymeric polyol (polymeric glycol) and hard segments composed of a chain extender and a diisocyanate. The polymeric polyol used as a starting material may be any that has hitherto been employed in the art relating to thermoplastic polyurethane materials, without particular limitation. Exemplary polymeric polyols include polyester polyols and polyether polyols, although polyether polyols are better than polyester polyols for synthesizing thermoplastic polyurethane materials that provide a high rebound resilience and have excellent low-temperature properties. Suitable polyether polyols include polytetramethylene glycol and polypropylene glycol. Polytetramethylene glycol is especially preferred for achieving a good rebound resilience and good low-temperature properties. The polymeric polyol has an average molecular weight of preferably 1,000 to 5,000. To synthesize a thermoplastic polyurethane material having a high rebound resilience, an average molecular weight of 2,000 to 4,000 is especially preferred.

Preferred chain extenders include those used in the prior art relating to thermoplastic polyurethane materials. Illustrative, non-limiting, examples include 1,4-butylene glycol, 1,2-ethylene glycol, 1,3-butanediol, 1,6-hexanediol, and 2,2-dimethyl-1,3-propanediol. These chain extenders have an average molecular weight of preferably 20 to 15,000.

Diisocyanates suitable for use include those employed in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. Depending on the type of isocyanate used, the crosslinking reaction during injection molding may be difficult to control. In the present invention, to ensure stable reactivity with the subsequently described isocyanate mixture (B), it is most preferable to use an aromatic diisocyanate, and specifically 4,4'-diphenylmethane diisocyanate.

A commercial product may be suitably used as the above-described thermoplastic polyurethane material. Illustrative examples include Pandex T-8290, Pandex T-8295 and Pandex T-8260 (all manufactured by DIC Bayer Polymer, Ltd.), and Resamine 2593 and Resamine 2597 (both manufactured by Dainichi Seika Colour & Chemicals Mfg. Co., Ltd.).

(B) Isocyanate Mixture

The isocyanate mixture (B) is prepared by dispersing (b-1) an isocyanate compound having as functional groups at least two isocyanate groups per molecule in (b-2) a thermoplastic resin that is substantially non-reactive with isocyanate. Above isocyanate compound (b-1) is preferably an isocyanate compound used in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. From the standpoint of reactivity and work safety, the use of 4,4'-diphenylmethane diisocyanate is most preferred.

The thermoplastic resin (b-2) is preferably a resin having a low water absorption and excellent compatibility with thermoplastic polyurethane materials. Illustrative, non-limiting, examples of such resins include polystyrene resins, polyvinyl chloride resins, ABS resins, polycarbonate resins and polyester elastomers (e.g., polyether-ester block copolymers, polyester-ester block copolymers). From the standpoint of rebound resilience and strength, the use of a polyester elastomer, particularly a polyether-ester block copolymer, is especially preferred.

In the isocyanate mixture (B), it is desirable for the relative proportions of the thermoplastic resin (b-2) and the isocyanate compound (b-1), expressed as the weight ratio (b-2):(b-1), to be from 100:5 to 100:100, and especially from 100:10 to 100:40. If the amount of the isocyanate compound (b-1) relative to the thermoplastic resin (b-2) is too small, a greater amount of the isocyanate mixture (B) will have to be added to achieve an amount of addition sufficient for the crosslinking reaction with the thermoplastic polyurethane material (A). As a result, the thermoplastic resin (b-2) will exert a large influence, compromising the physical properties of the cover-molding material (C). On the other hand, if the amount of the isocyanate compound (b-1) relative to the thermoplastic resin (b-2) is too large, the isocyanate compound (b-1) may cause slippage to occur during mixing, making preparation of the isocyanate mixture (B) difficult.

The isocyanate mixture (B) can be obtained by, for example, adding the isocyanate compound (b-1) to the thermoplastic resin (b-2) and thoroughly working together these components at a temperature of 130 to 250° C. using mixing rolls or a Banbury mixer, then either pelletizing or cooling and subsequently grinding. A commercial product such as Crossnate EM30 (made by Dainichi Seika Colour & Chemicals Mfg. Co., Ltd.) may be suitably used as the isocyanate mixture (B).

(C) Cover-Molding Material

The cover-molding material (C) is composed primarily of the above-described thermoplastic polyurethane material (A) and isocyanate mixture (B). The relative proportion of the thermoplastic polyurethane material (A) to the isocyanate mixture (B) in the cover-molding material (C), expressed as the weight ratio (A):(B), is preferably from 100:1 to 100:100, more preferably from 100:5 to 100:50, and even more preferably from 100:10 to 100:30. If too little isocyanate mixture (B) is included with respect to the thermoplastic polyurethane material (A), a sufficient crosslinking effect will not be achieved. On the other hand, if too much is included, unreacted isocyanate may discolor the molded material.

In addition to the above-described ingredients, other ingredients may be included in the cover-molding material (C). For example, thermoplastic polymeric materials other than the thermoplastic polyurethane material may be included; illustrative examples include polyester elastomers, polyamide elastomers, ionomer resins, styrene block elastomers, polyethylene and nylon resins. Thermoplastic polymeric materials other than the thermoplastic polyurethane material may be included in an amount of 0 to 100 parts by weight, preferably 10 to 75 parts by weight, and more preferably 10 to 50 parts by weight, per 100 parts by weight of the thermoplastic polyurethane material serving as the essential component. The amount of such thermoplastic polymeric materials used is selected as appropriate for such purposes as adjusting the hardness of the cover material, improving the rebound, improving the flow properties, and improving adhesion. If necessary, various additives such as pigments, dispersants, antioxidants, light stabilizers, ultraviolet absorbers and parting agents may also be suitably included in the cover-molding material (C).

Formation of the cover from the cover-molding material (C) can be carried out by adding the isocyanate mixture (B) to the thermoplastic polyurethane material (A) and dry mixing, then using an injection molding machine to mold the mixture into a cover over the core. The molding temperature varies with the type of thermoplastic polyurethane material (A), although molding is generally carried out within a temperature range of 150 to 250° C.

Reactions and crosslinking which take place in the golf ball cover obtained as described above are believed to involve the reaction of isocyanate groups with hydroxyl groups remaining in the thermoplastic polyurethane material to form urethane bonds, or the creation of an allophanate or biuret crosslinked form via a reaction involving the addition of isocyanate groups to urethane groups in the thermoplastic polyurethane material. Although the crosslinking reaction has not yet proceeded to a sufficient degree immediately after injection molding of the cover-molding material (C), the crosslinking reaction can be made to proceed further by carrying out an annealing step after molding, in this way conferring the golf ball cover with useful characteristics. "Annealing," as used herein, refers to heat aging the cover at a constant temperature for a given length of time, or aging the cover for a fixed period at room temperature.

As in methods for molding the cover of a conventional golf ball, any of various known methods, such as injection molding and compression molding, may be used to form the above intermediate layer and cover. The intermediate layer and cover can easily be formed by suitably selecting conditions such as the injection temperature and time within the commonly used ranges.

In the practice of the invention, the hardness of the overall ball, expressed as the deflection when the ball is compressed from an initial load state of 98 N (10 kgf) to a final load of 1,275 N (130 kgf), is preferably from 2.8 to 4.0 mm, more preferably from 3.0 to 3.7 mm, and even more preferably from 3.2 to 3.5 mm. If this value is too small, the ball may travel too far when hit with a W#1 and a good feel may not be attained. On the other hand, if the value is too large, the distance may drop too much when the ball is hit with a W#1 or even when it is hit with an iron, and the durability to cracking on repeated impact may worsen.

The initial velocity of the golf ball, while not subject to any particular limitation, is preferably in a range of 65 to 77 m/s, more preferably 70 to 76.6 m/s, and even more preferably 75 to 76.3 m/s. If the initial velocity is too much higher than the above range, it may not be possible to sufficiently limit the distance traveled by the ball when hit with a W#1. On the other hand, if the initial velocity is too low, the distance may drop when the ball is hit with a W#1 or even when it is hit with an iron. The initial velocity is measured using an initial velocity measuring apparatus of the same type as the USGA drum rotation-type initial velocity instrument approved by the R&A. The ball is temperature-conditioned for 3 hours at 23±1° C., then tested in a 23±2° C. chamber by being hit with a 250-pound (113.4 kg) head (striking mass) at an impact velocity of 143.8 ft/s (43.83 m/s). One dozen balls are each hit four times. The time taken to traverse a distance of 6.28 ft (1.91 m) is measured and used to compute the initial velocity (m/s) of the ball. This cycle is carried out over a period of about 15 minutes.

In a golf ball of the invention where, letting V be the initial velocity (m/s) of the ball as measured by a method set forth in the Rules of Golf using an initial velocity measuring apparatus of the same type as the USGA drum rotation-type initial velocity instrument and letting E be the deflection (mm) of the ball when subjected to compression from an initial load state of 98 N (10 kgf) to a final load of 1,275 N (130 kgf), it is recommended that the value of V/E, while not subject to any particular limitation, be preferably at most 28, more preferably at most 25, and even more preferably at most 23. If this value is too large, the actual initial velocity when the ball is hit with a W#1 will be too high, which may make it impossible to reduce the distance traveled by the ball. The lower limit in the value of V/E, while not subject to any particular limitation, is preferably at least 10, more preferably at least 15, and even more preferably at least 20. If this value is too small, the actual initial velocity may end up being too low, as a result of which the distance traveled by the ball when hit with an iron may drop too much.

Numerous dimples may be formed on the surface of the above-described cover. The number of dimples arranged on the cover surface, while not subject to any particular limitation, is preferably at least 300 but not more than 600, more preferably at least 330 but not more than 500, and even more preferably at least 400 but not more than 450. If the number of dimples is higher than the above range, the ball may have too low a trajectory, which may give the ball an image that is so different from that of the current game ball as to make players uneasy about making the transition from the current game ball. Conversely, if the number of dimples is lower than the above range, the ball may assume a high trajectory, and may be readily subject to wind effects, making it more difficult to play golf.

The dimples may be of a circular shape or a non-circular shape, examples of the latter being various polygonal shapes, a dew drop shape, and other elliptical shapes. Any one or combination of two or more of these shapes may be suitably used. For example, if the dimples are circular, dimples having a diameter of generally at least about 1.5 mm but not more than about 7.0, preferably at least 2.0 mm but not more than 6.0 mm, and more preferably at least 2.5 mm but not more than 4.0 mm, may be used. The depth of the dimple from a flat plane circumscribed by the edge of the dimple is generally at least 0.05 mm but not more than 0.4 mm, and preferably at least 0.1 mm but not more than 0.3 mm.

To optimize the trajectory of the ball, the value $V_0$ for each dimple, defined as the volume of space in the dimple below a flat plane circumscribed by the edge of the dimple, divided by the volume of a cylinder whose base is the flat plane and whose height is the maximum depth of the dimple from the base, may be set in a range of preferably 0.3 to 0.8, and more preferably 0.4 to 0.7.

To take full advantage of their aerodynamic properties, it is preferable for the dimples to have a coverage on the spherical surface of the golf ball, expressed as the sum of the individual dimple surface areas defined by the border of the flat plane circumscribed by the edge of the dimple as a proportion SR of the spherical surface area of the ball were it to have no dimples thereon, of generally from 0.6 to 0.9, and preferably from 0.7 to 0.86.

Moreover, the VR value, which is the sum of the dimple volumes below the flat plane circumscribed by the edge of each respective dimple, expressed as a percentage of the volume of golf ball sphere were it to have no dimples thereon, can be set to generally from 0.6 to 1%, and preferably from 0.7 to 0.9%. Outside of this range, it becomes impossible to obtain a good trajectory.

The golf ball of the invention may be formed to a diameter of generally at least 42.67 mm, and preferably from 42.67 to 43.00 mm, and to a weight of generally from 45.0 to 45.93 g. Moreover, to achieve the objects of the invention, it is desirable for the inventive golf ball to comply with the 2006 R&A Rules of Golf. Specifically, it is desirable for the golf ball to: (1) not pass through a ring having an inside diameter of 42.672 mm, (2) have a weight of not more than 45.93 g, and (3) have an initial velocity of not more than 77.724 m/s.

As explained above, the present invention provides a golf ball which is beneficial for use in competitive play, which ball has a reduced distance compared with official golf balls in current use, yet has a relatively soft and good feel on impact, excellent controllability and scuff resistance, and minimizes the extent of the drop in distance when hit with an iron, thus having little adverse effect play by the amateur golfer.

EXAMPLES

Examples of the invention and Comparative Examples are given below by way of illustration, and not by way of limitation.

Examples 1 and 2, Comparative Examples 1 to 6

Rubber compositions formulated as shown in Table 1 below were prepared for the production of the golf balls in Examples 1 and 2 of the invention and Comparative Examples 1 to 6. These rubber compositions were suitably masticated with a kneader or roll mill, then vulcanized at 157° C. for 15 minutes to form solid cores. Numbers shown for each material in the table indicate parts by weight.

A 2006 model golf ball made by Bridgestone Sports Co., Ltd. as a practice ball was used as Comparative Example 6. This ball had a one-piece construction composed of a single rubber layer, and served as one control for comparison with the invention.

TABLE 1

| | | Example | | Comparative Example | | | | |
|---|---|---|---|---|---|---|---|---|
| | | 1 | 2 | 1 | 2 | 3 | 4 | 5 |
| Core formulation | Polybutadiene (1) | 80 | 80 | 80 | 80 | 80 | 80 | 80 |
| | Polybutadiene (2) | 20 | 20 | 20 | 20 | 20 | 20 | 20 |
| | Zinc acrylate | 30 | 28.5 | 30 | 30 | 36 | 30 | 30 |
| | Peroxide (1) | 0 | 0 | 0 | 0 | 0 | 0 | 0 |
| | Peroxide (2) | 3 | 3 | 3 | 3 | 3 | 3 | 3 |
| | Sulfur | 0.1 | 0.1 | 0.1 | 0.1 | 0.1 | 0.1 | 0.1 |
| | Antioxidant | 0.1 | 0.1 | 0.1 | 0.1 | 0.1 | 0.1 | 0.1 |
| | Zinc oxide | 22.1 | 22.5 | 27.2 | 10.7 | 8.7 | 22.1 | 22.1 |
| | Zinc pentachlorothiophenol | 1.5 | 1.5 | 1.5 | 1.5 | 1.5 | 1.5 | 1.5 |
| | Zinc stearate | 5 | 5 | 5 | 5 | 5 | 5 | 5 |
| | Zinc pentachlorothiophenol amount/sulfur amount | 15 | 15 | 15 | 15 | 15 | 15 | 15 |
| Vulcanization method | Temperature (° C.) | 157 | 157 | 157 | 157 | 157 | 157 | 157 |
| | Time (min) | 15 | 15 | 15 | 15 | 15 | 15 | 15 |

The above materials are described below. Numbers in the Table 1 represent parts by weight.

Polybutadiene (1): BR730 (trade name), available from JSR Corporation.

Polybutadiene (2): BR51 (trade name), available from JSR Corporation.

Peroxide (1): Dicumyl peroxide, produced by NOF Corporation under the trade name Percumyl D.

Peroxide (2): 1,1-Di(t-butylperoxy)cyclohexane, produced by NOF Corporation under the trade name Perhexa C-40.

Sulfur: Zinc white-sulfur mixture (Tsurumi Chemical Industry Co., Ltd.).

Antioxidant: 2,6-Di-t-butyl-4-methylphenol, produced by Ouchi Shinko Chemical Industry Co., Ltd. under the trade name Nocrac 200.

Zinc stearate: Produced by NOF Corporation under the trade name Zinc Stearate G.

Figure 2:
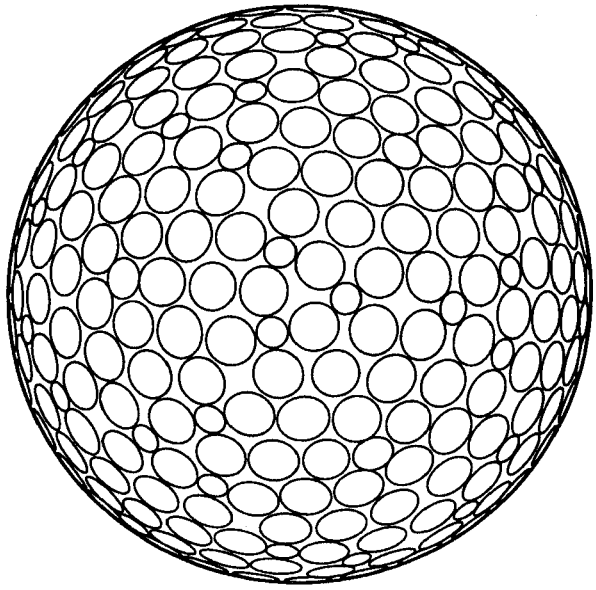
FIG. 2 is a top view showing a dimple arrangement used in the same embodiment.

Next, the cover materials I to III shown in Table 2 below were injection-molded over the solid cores in the respective examples according to the invention and the comparative examples, with the exception of Comparative Example 6, following which the cover materials IV to VI shown in Table 2 were injection-molded onto the surface of the intermediate layer, giving a three-piece golf ball. It should be noted that Comparative Example is a two-piece golf ball, and Comparative Example 6 is a one-piece golf ball. The cover used in each example was injection-molded while at the same time numerous dimples were formed on the outside surface of the cover. The dimples had the arrangement pattern shown in FIG. 2. The same dimple configuration was used in all of the examples and comparative examples. The details are given in Table 3.

TABLE 2

| | I | II | III | IV | V | VI |
|---|---|---|---|---|---|---|
| AM7331 | 100 | | | | | |
| Himilan 1605 | | | 70 | | | |
| Himilan 1855 | | | | 35 | | |
| Surlyn 8120 | | | | 35 | | |
| Surlyn 7930 | | | 30 | | | |
| Hytrel 4767 | | 100 | | | | |
| AN4311 | | | | 30 | | |
| Titanium oxide | 0 | 0 | 0 | 4 | 3.8 | 3.8 |
| Trimethylolpropane | 1.1 | | 1.1 | | | |
| Pandex T8260 | | | | | | 100 |
| Pandex T8290 | | | | | 50 | |
| Pandex T8295 | | | | | 50 | |

TABLE 2-continued

| | I | II | III | IV | V | VI |
|---|---|---|---|---|---|---|
| Polyethylene wax | | | | | 1.4 | 1.4 |
| Isocyanate compound | | | | | 18 | 18 |

Note:
Numbers for the respective components indicate parts by weight.

Details concerning the above trade names are given below.

AM7331, Himilan 1605, Himilan 1855:

Ionomer resins available from DuPont-Mitsui Polychemicals Co., Ltd.

Surlyn 8120, Surlyn 7930:

Ionomer resins available from E.I. DuPont de Nemours & Co.

Hytrel 4767:

A polyether-ester elastomer available from DuPont-Toray Co., Ltd.

AN4311:

Nucrel, available from DuPont-Mitsui Polychemicals Co., Ltd.

Pandex T-8260, Pandex T-8290, Pandex T-8295:

MDI-PTMG-type thermoplastic polyurethanes available from DIC Bayer Polymer under the trademark designation Pandex.

Isocyanate Compound:

Crossnate EM30 (trade name), an isocyanate masterbatch which is produced by Dainichi Seika Colour & Chemicals Mfg. Co., Ltd., contains 30% of 4,4'-diphenylmethane diisocyanate (measured concentration of amine reverse-titrated isocyanate according to JIS-K1556, 5 to 10%), and in which the masterbatch base resin is a polyester elastomer. Admixture of the isocyanate compound was carried out simultaneous with injection molding.

TABLE 3

| | Number | Diameter (mm) | Depth (mm) | $V_0$ | Planar SR | Planar VR | Spherical VR |
|---|---|---|---|---|---|---|---|
| 1 | 288 | 3.89 | 0.15 | 0.48 | 0.80 | 0.787 | 1.257 |
| 2 | 60 | 3.81 | 0.15 | 0.48 | Planar | Planar | Spherical |
| 3 | 12 | 2.94 | 0.13 | 0.48 | surface | volume: | volume: |
| 4 | 60 | 2.38 | 0.10 | 0.48 | area: | 321 $mm^3$ | 512 $mm^3$ |
| 5 | 12 | 3.40 | 0.14 | 0.48 | 4,564 $mm^2$ | | |
| Total | 432 | | | | | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

Planar SR: Sum of individual dimple surface areas, each defined by the border of the flat plane circumscribed by the edge of the dimple, as a percentage of spherical surface area of ball were it to have no dimples thereon.

Planar VR: Sum of volumes of individual dimples formed below flat plane circumscribed by the edge of the dimple, as a percentage of volume of ball sphere were it to have no dimples thereon.

Spherical VR: Sum of volumes of individual dimples formed below spherical surface (assuming the spherical surface to be free of dimples) circumscribed by the edge of the dimple, as a percentage of volume of ball sphere were it to have no dimples thereon.

Table 4 shows the properties of the golf balls obtained in the respective examples of the invention and the comparative examples, as well as test results for flight, feel and scuff resistance.

TABLE 4

| | | Example | | Comparative Example | | | | | |
|---|---|---|---|---|---|---|---|---|---|
| | | 1 | 2 | 1 | 2 | 3 | 4 | 5 | 6 |
| Solid core | Diameter (mm) | 37.2 | 37.2 | 37.3 | 37.3 | 38.9 | 37.3 | 37.2 | |
| | Weight (g) | 32.0 | 32.0 | 32.8 | 30.2 | 34.5 | 32.0 | 32.0 | |
| | Deflection (mm) | 3.9 | 4.1 | 3.9 | 3.9 | 3.2 | 3.9 | 3.9 | |
| | Core surface hardness D | 54 | 53 | 54 | 54 | 59 | 54 | 54 | |
| | Core center hardness D | 37 | 36 | 37 | 37 | 40 | 37 | 37 | |
| | Core surface - center | 17 | 17 | 17 | 17 | 19 | 17 | 17 | |
| Intermediate layer material | No. | I | I | I | II | — | III | I | |
| | Specific gravity | 0.95 | 0.95 | 0.95 | 1.15 | — | 0.95 | 0.95 | |
| | Material hardness D (sheet hardness) | 47 | 47 | 47 | 47 | — | 63 | 47 | |
| | Thickness (mm) | 1.7 | 1.7 | 1.7 | 1.7 | — | 1.7 | 1.7 | |
| Intermediate layer-covered sphere | Outside diameter (mm) | 40.7 | 40.7 | 40.7 | 40.7 | — | 40.7 | 40.7 | |
| | Weight (g) | 39.8 | 39.8 | 40.6 | 39.7 | — | 39.8 | 39.8 | |
| Cover material | No. | V | V | IV | V | V | V | VI | |
| | Type | urethane | urethane | ionomer | urethane | urethane | urethane | urethane | |
| | Thickness (mm) | 1.0 | 1.0 | 1.0 | 1.0 | 1.9 | 1.0 | 1.0 | |
| | Material hardness D (sheet hardness) | 48 | 48 | 48 | 48 | 48 | 48 | 58 | |
| Ball | Diameter (mm) | 42.7 | 42.7 | 42.7 | 42.7 | 42.7 | 42.7 | 42.7 | |
| | Weight (g) | 45.6 | 45.6 | 45.5 | 45.5 | 45.5 | 45.6 | 45.6 | |
| | Deflection (mm) | 3.4 | 3.5 | 3.4 | 3.4 | 3.4 | 2.7 | 2.9 | 2.6 |
| | Initial velocity (m/s) | 76.0 | 75.9 | 75.7 | 76.3 | 76.5 | 77.3 | 76.0 | 73.7 |
| Intermediate layer material hardness - Core surface hardness D | | −7 | −6 | −7 | −7 | | 9 | −7 | |

TABLE 4-continued

| | | | Example | | Comparative Example | | | | | |
|---|---|---|---|---|---|---|---|---|---|---|
| | | | 1 | 2 | 1 | 2 | 3 | 4 | 5 | 6 |
| Cover material hardness - Core surface hardness D | | | −6 | −5 | −6 | −6 | −11 | −6 | 4 | |
| Ball initial velocity/ Ball 10-130 kgf deflection | | | 22.3 | 21.7 | 22.3 | 22.4 | 22.5 | 28.6 | 26.2 | 28.3 |
| Flight performance | W#1 HS, 45 m/s | Carry (m) | 208.9 | 208.1 | 207.7 | 210.1 | 212.5 | 217.6 | 211.9 | 205.9 |
| | | Total distance (m) | 219.6 | 219.1 | 218.4 | 222.2 | 224.5 | 229.7 | 222.6 | 210.5 |
| | | Rating | good | good | good | NG | NG | NG | NG | good |
| | I#9 HS, 38 m/s | Total distance (m) | 103.3 | 103.7 | 103.5 | 103.9 | 104.0 | 105.2 | 104.8 | 99.1 |
| | Rating | Rating | good | good | good | good | good | good | good | NG |
| Feel | W#1 | | good | good | good | good | good | fair | good | fair |
| | Putter | | good | good | good | good | good | good | fair | good |
| Scuff resistance | | | good | good | NG | good | good | good | NG | good |

Deflection (1) Deformation (mm) by the core when compressed from an initial load state of 98 N (10 kgf) to a final load of 1,275 N (130 kgf) was measured.

(2) Deformation (mm) by the ball sphere when compressed from an initial load state of 98 N (10 kgf) to a final load of 1,275 N (130 kgf) was measured.

Shore D Hardness at Core Surface and Core Center

For the Shore D hardness at the core surface, aside from setting the durometer indenter substantially perpendicular to the spherical surface of the core, the hardness was measured in accordance with ASTM D2240. For the Shore D hardness at the center of the core, the core was cut into two halves, and the hardness at the center portion of the cut face was measured in accordance with ASTM D2240.

Material Hardness of Intermediate Layer

The intermediate layer composition made primarily of ionomer was formed under applied heat and pressure to a thickness of about 2 mm, and the resulting sheet was held for 2 weeks, following which the Shore D hardness was measured in accordance with ASTM D2240.

Material Hardness of Cover

The cover composition made primarily of polyurethane was injection-molded as a 2 mm thick sheet, and the resulting sheet was held for about 2 weeks, following which the Shore D hardness was measured in accordance with ASTM D2240.

Flight

The club was mounted on a golf swing robot, and the distance traveled by the ball when hit under various conditions was measured. The results were rated according to the following criteria. The following clubs were used.

W#1, HS 45 m/s:

Tour Stage X500 with loft angle of 90, manufactured by Bridgestone Sports Co., Ltd.

Good: Total distance was less than 220 m

NG: Total distance was 220 m or more

I#9, HS 38 m/s:

TourStage X-Blade, manufactured by Bridgestone Sports Co., Ltd.

Good: Total distance was 100 m or more

NG: Total distance was less than 100 m

Feel

The feel on impact of each ball when hit with a W#1 was sensory evaluated by 20 amateur golfers having head speeds of 40 to 45 m/s, and rated as follows.

Good: 15 or more of the golfers rated the ball as having a good, soft feel.

Fair: 10 to 14 of the golfers rated the ball as having a good feel

NG: Fewer than 10 of the golfers rated the ball as having a good feel.

Scuff Resistance

A non-plated pitching sand wedge was set in a swing robot, and the ball was hit once at a head speed of 40 m/s, following which the surface state of the ball was visually examined and rated as follows.

Good: Can be used again

NG: Cannot be used again

The golf ball of Comparative Example 1, in which the cover was made of an ionomer, exhibited a poor scuff resistance.

The golf ball of Comparative Example 2, in which the intermediate layer was made of a polyester elastomer rather than an ionomer, had a high rebound and did not sufficiently limit the distance of travel when hit with a W#1.

The golf ball of Comparative Example 3, which had a two-piece construction that included a urethane cover and lacked an intermediate layer, exhibited a high rebound and did not sufficiently limit the distance of travel.

The golf ball of Comparative Example 4, in which the intermediate layer was harder than the surface of the core, had both a high rebound and a low spin rate, resulting in an excessive distance.

The ball of Comparative Example 5, in which the cover was harder than the core surface, had too low a spin rate when hit with a W#1, resulting in an excessive distance. Moreover, the cover was too hard and the scuff resistance was poor.

The ball of Comparative Example 6, which was a one-piece practice golf ball, exhibited a loss of distance when hit with a W#1, or even when hit with an iron.

The invention claimed is:

1. A golf ball comprising a resilient core made of rubber, a cover of one or more layers encasing the core, and at least one intermediate layer disposed between the core and the cover, wherein the cover is made primarily of polyurethane, the intermediate layer is made primarily of ionomer, and the core has a surface hardness which is higher than the material hardnesses of the cover and the intermediate layer, wherein a diameter of the core ranges from 35 mm to 40 mm, the surface hardness of the core ranges from 45 to 60 shore D, and the core center hardness ranges from 25 to 50 shore D, wherein a difference between the cover hardness and the core surface hardness expressed in Shore D hardness units ranges from −12 to −2.

2. The golf ball of claim 1, wherein an initial velocity V of the golf ball is measured by a method set forth in the Rule of Golf using a USGA drum rotation-type initial velocity instrument, the initial velocity V of the ball is at least 65 m/s but not more than 76.3 m/s.

3. The golf ball of claim 1, wherein a deflection E of the ball is measured between an initial load of 98 N and a final load of 1,275 N, the deflection E of the ball is at least 2.8 mm.

4. The golf ball of claim 1, wherein a difference between the surface hardness of the core and the core center hardness ranges from 10 to 30 shore D.

5. The golf ball of claim 1, wherein a thickness of the intermediate layer ranges from 0.7 mm to 3.0 mm.

6. The golf ball of claim 1, wherein the material hardness of the cover ranges from 40 to 60 shore D.

7. The golf ball of claim 1, wherein the difference between the intermediate layer hardness and the core surface hardness expressed in Shore D hardness units ranges from −12 to −2.

8. The golf ball of claim 1, wherein the surface of the intermediate layer is a ground surface and the ground surface is painted with a primer, or an adhesion enhancer is added to the intermediate layer material.

9. The golf ball of claim 1, wherein the cover is made of a cover-molding material (C) composed primarily of the following components (A) and (B):

(A) a thermoplastic polyurethane material; and (B) an isocyanate mixture of (b-1) an isocyanate compound having two or more isocyanate groups as functional groups per molecule, dispersed in (b-2) a thermoplastic resin being substantially non-reactive with isocyanate.

* * * * *